US011441779B2

(12) United States Patent
Ribassin et al.

(10) Patent No.: US 11,441,779 B2
(45) Date of Patent: Sep. 13, 2022

(54) CONFIGURING AND POSITIONING AIR PASSAGE HOLES IN A COMBUSTION CHAMBER WALL

(71) Applicant: Safran Aircraft Engines, Paris (FR)

(72) Inventors: François Pierre Ribassin, Moissy-Cramayel (FR); Patrice André Commaret, Moissy-Cramayel (FR); Romain Nicolas Lunel, Moissy-Cramayel (FR); Christophe Pieussergues, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 232 days.

(21) Appl. No.: 16/850,114

(22) Filed: Apr. 16, 2020

(65) Prior Publication Data

US 2020/0333008 A1 Oct. 22, 2020

(30) Foreign Application Priority Data

Apr. 18, 2019 (FR) ..... 1904171

(51) Int. Cl.
*F23R 3/04* (2006.01)

(52) U.S. Cl.
CPC ..... *F23R 3/04* (2013.01); *F05D 2230/10* (2013.01); *F05D 2240/35* (2013.01)

(58) Field of Classification Search
CPC ..... F23R 3/04; F05D 2230/10; F05D 2240/35
See application file for complete search history.

(56) References Cited

U.S. PATENT DOCUMENTS

2005/0081526 A1 4/2005 Howell et al.
2009/0100839 A1* 4/2009 Cazalens ..... F23R 3/06 60/754

FOREIGN PATENT DOCUMENTS

EP 2 053 311 A1 4/2009
WO WO 2015/116269 A2 8/2015

* cited by examiner

*Primary Examiner* — Nirvana Deonauth
(74) *Attorney, Agent, or Firm* — Blank Rome LLP

(57) ABSTRACT

The provision of air passage holes through a wall of a gas turbomachine combustion chamber. Multi-perforations are virtually positioned and distributed, even in a first safety zone without air passage openings. Multi-perforations with a virtual inlet or outlet in this first security zone are virtually removed. According to certain criteria, at least some of said removed multi-perforations are then virtually reintegrated, and, from then on a perimeter passing through the virtual inlets and outlets of all the multi-perforations present is defined, in the direction of a primary or dilution hole to be installed, a modified safety zone is defined, then, respecting around said hole and with the freedom to reposition it within this limit, the shape of this hole is redefined.

9 Claims, 6 Drawing Sheets

CONFIGURING AND POSITIONING AIR PASSAGE HOLES IN A COMBUSTION CHAMBER WALL

CROSS-REFERENCE TO RELATED APPLICATION

This application claims the benefit of French Patent Application No. 1904171, filed on Apr. 18, 2019, the contents of which is incorporated by reference herein.

BACKGROUND/SUMMARY OF THE INVENTION

The present invention relates to a method for configuring and positioning air passage holes through a wall of an aircraft gas turbomachine combustion chamber.

One of the major problems with these combustion chambers is the service life of the inner and outer walls.

It is known that in this field, a combustion chamber comprises:

two inner and outer walls (also known as inner and outer annular shells, respectively), and a chamber end wall (FDC) which can be protected by a ring of baffles mounted in the chamber directly downstream of the chamber end wall.

The degradation of the inner and outer walls, which limits their service life, is particularly due to the thermal gradient between the hot (uncooled) and cold (cooled) zones of the combustion chamber.

It is also known to provide the inner and outer walls with multi-perforation holes allowing air to be brought into the furnace of the combustion chamber to limit these thermal gradients and therefore the hot zones.

Thus, it is preferable to limit as much as possible the non multi-perforated zones in order to have a material density as homogeneous as possible over the entire length of the wall considered.

Configuring and positioning (the) air passage holes through an aircraft gas turbomachine combustion chamber wall is therefore delicate and demanding.

Among the requirements could be that of not complicating the manufacturing process by adding particular multi-perforations around the holes, and therefore wishing to keep a "conventional" configuration, in line with an already existing configuration.

It is in this context that the invention proposes to reduce as far as possible these undrilled zones around the safety zone usually provided around the primary or dilution holes and to keep as many multi-perforation holes as possible by adapting the shape of the primary and dilution holes. The (All) through holes in this zone are deleted. Removing these holes involves undrilled zones around the safety zone.

A so-called "safety" zone around primary and/or dilution holes is a part of the wall that never is multi-perforated in order to prevent defects related to mechanical and thermal tolerances, cracking and the manufacture of the wall.

Typically, the inner and outer walls are each provided with a plurality of holes and miscellaneous air intake ports allowing air flowing around the combustion chamber to enter the combustion chamber.

Thus, in addition to multi-perforation holes, so-called "primary" and/or "dilution" holes are formed in these walls for this purpose. The air flowing through the primary holes helps to create an air/fuel mixture that is burnt in the chamber, while the air from the dilution holes is intended to help dilute the same air/fuel mixture.

More specifically, the invention thus provides for a method for configuring (or designing) and positioning air passage holes through an aircraft gas turbomachine combustion chamber wall, wherein at least one of a primary hole and a dilution hole is virtually positioned on the wall, with such method being more particularly characterized in that, before machining said at least one of a primary hole and a dilution hole:

a) over at least one predetermined distance (X) from and around said at least one primary hole and a dilution hole, a predetermined first safety zone is defined in which no air passage hole is a priori to be provided, b) on the wall (possibly in the first safety zone thereof), multi-perforation holes are positioned virtually and distributed, each of said multi-perforation holes having virtual air inlets and virtual air outlets, c) those of the multi-perforation holes which have said virtual air inlet or virtual air outlet located in said first safety zone, are virtually removed, d) if, around said at least one of a primary hole and a dilution hole, a hole-free zone is then identified:

d1) which is more extensive than said first safety zone, and/or d2) where distances between a perimeter of said hole-free zone and said at least one of a primary hole and a dilution hole then vary according to an angular sector considered around said at least one of a primary hole and a dilution hole:

d21) at least some of the removed multi-perforation holes are virtually reintegrated with at least one of said virtual air inlet and virtual air outlet closest to a periphery of said first safety zone, and d22) while keeping the multi-perforation holes virtually reintegrated, and from then on a second perimeter passing through all the virtual air inlets and virtual air outlets of all the multi-perforation holes adjacent to and surrounding said at least one of a primary hole and a dilution hole, a modified safety zone which is free of air passage hole and which is of different shape from the first safety zone is defined towards said at least of a primary hole and a dilution hole, and, e) while respecting around said at least one of a primary hole and a dilution hole the limits of said modified safety zone, the shape of said at least one primary of a primary hole and a dilution hole is redefined, with a freedom to reposition said at least one of a primary hole and a hole within said limits.

In step c), the phrase "multi-perforation holes are virtually removed . . . " implies that all, or only some, of the multi-perforation holes with a virtual inlet or outlet located in said first safety zone can be removed.

With the solution presented, we will be able to have more multi-perforation holes than we would have had without the invention. And so, all other things being equal, we are going to limit the thermal gradients and therefore the hot zones mentioned above.

On this subject, it may be wished that the primary or dilution hole(s) initially considered and positioned virtually on the defined wall is (are):

cylindrical, with a circular cross-section, and/or defined with initially a predetermined air passage cross-section (S1).

The use of such holes is nowadays well mastered. Starting from this reference can therefore be considered as a guarantee of safety, even if ovalized holes could for example be provided.

Concerning the "predetermined distance" and the definition, which depends on it, of said first safety zone, it will then be established from and around the axis of the primary or dilution hole in question.

In the same vein, it may be found appropriate that said at least one primary or dilution hole positioned virtually on the wall has an axis and that, in step a), said predetermined distance corresponds to a constant radius centered on said axis.

On this subject, if we consider that the surface on which the virtual steps are conducted and the different "definitions" made are planes (two-dimensional surfaces), then it is in this plane that this radius and the other distances involved will be considered (see attached figures).

Favorably, said first safety zone and modified safety zone will depend on said virtual positioning and distribution of the multi-perforation holes.

According to another characteristic, it is proposed:

that the second perimeter will be defined by a polygonal line, and that the contour of the redefined shape of said at least one primary or dilution hole will essentially follow said polygonal line.

This will make it possible to orientate, if desired, towards its final shape said primary or dilution hole, surrounded by its modified safety zone; in fact, it will be possible to choose that the shape of said hole essentially will reproduce (to scale, to the nearest rounded corners) that of said polygonal line.

Many different hole shapes are thus potentially accessible. However, it is preferable, again for a compromise between performance and relative simplicity of implementation, for the angles between the successive sections of the polygonal line to all go in the same direction: that of the closing of the line on itself.

Furthermore, with respect to said at least one primary or dilution hole (initially) positioned virtually on the wall, its section (S1) may be predetermined in order to maintain it. In this case, it may be usefully desired (step e) that, when redefining the shape of this same primary or dilution hole, said predetermined section will be selected.

This is once again a guarantee of safety and has been seen as an appropriate compromise between performance and relative simplicity of implementation. And one will be able to favor a preservation of the conditions initially defined with (the air passage section of) the original primary or dilution hole and the multi-perforation holes initially distributed and positioned.

That said, the final stage of shape redefinition may or may not be reached right away. Indeed, during (or at the end of) said step (e) it may be considered/decided that said at least one primary or dilution hole with its redefined shape is ultimately unsuitable. Two hypotheses were then more particularly selected:

1/First hypothesis: a subsequent step (f2 below) is then carried out comprising, while respecting said modified safety zone, a new redefinition of the shape, and therefore a possible repositioning, of said at least one primary or dilution hole, with a change in said predetermined section (S1), which is a priori smaller.

2/Second hypothesis: it is chosen/decided to no longer respect the modified safety zone; in this case, a step f3) is then carried out comprising (at least) a reiteration of step d21) including a virtual reintegration of more or less multi-perforation holes than in the previous step d21), followed by a reiteration of steps d22) and e).

It is then by iteration(s) that the configure (shape/section) and the positioning of the primary or dilution hole will finally be decided.

The invention will be better understood and other details, characteristics and advantages of the invention will appear when reading the following description, which is given as a non-limiting example, with reference to the attached drawings.

DETAILED DESCRIPTION

Figure 1:
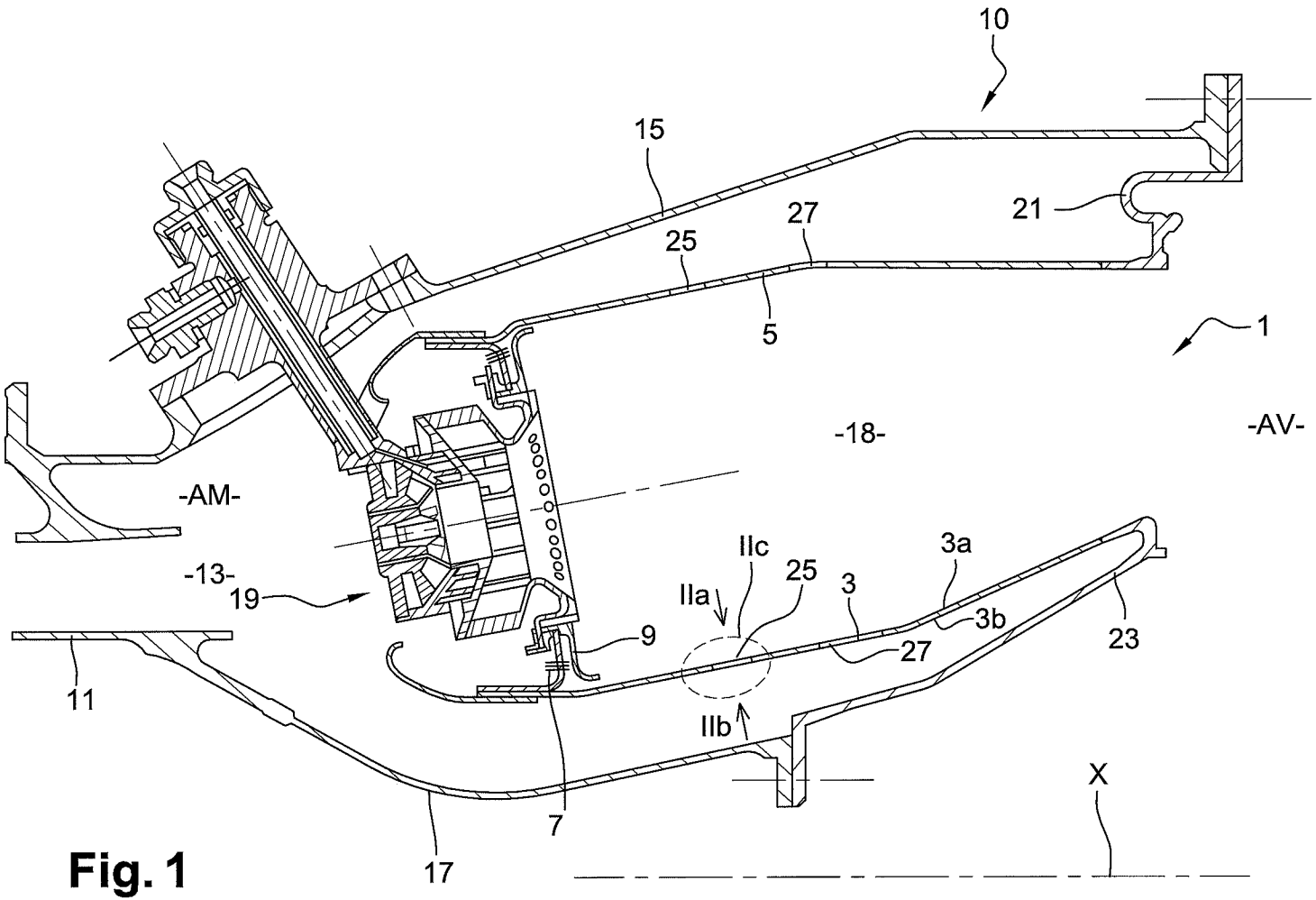
FIG. 1 is a general longitudinal (X-axis) cross-sectional view of a combustion chamber portion of an aircraft turbomachine.

FIG. 1 first shows a combustion chamber 1 of an aircraft gas turbomachine, such as a turbofan engine.

The combustion chamber 1 comprises:

two inner 3 and outer 5 wall (also known as inner and outer annular shells, respectively, which may be metallic), and a chamber end wall 7 (FDC) which can be protected by a ring of baffles 9 mounted in the chamber directly downstream of the chamber end wall 7.

The combustion chamber 1 is located, along the X axis of revolution of the turbomachine 10, downstream (AV) of a compressor, which may be a high-pressure compressor arranged axially after a low-pressure compressor. A ring-shaped air diffuser 11 is connected downstream of the compressor. The diffuser 11 opens into a space 13 surrounding an, here annular, combustion chamber 1. The space 13 is delimited by an outer casing 15 and an inner casing 17, both annular and coaxial to the X axis of the turbomachine. The combustion chamber 1 is held downstream by fixing flanges. The compressed air introduced into the furnace 18 of the combustion chamber 1 is mixed therein with fuel from injectors, such as the injectors 19. The gases from the combustion are directed to a (here high pressure) turbine located downstream (AV) of the outlet of the chamber 1, and first to a nozzle which is part of the stator of the turbomachine.

The inner 3 and outer 5 walls, of revolution are connected upstream to the annular transverse wall, or chamber end wall. They delimit with it (or with the ring of baffles 9) the furnace 18. In the example, (radially) outer 21 and inner 23 annular flanges, respectively, hold the chamber 1 at the downstream end, here by attachment to the outer 15 and inner 17 housings, respectively.

The inner wall 3 and/or outer wall 5 are crossed by primary holes 25 and dilution holes 27.

Figure 3:
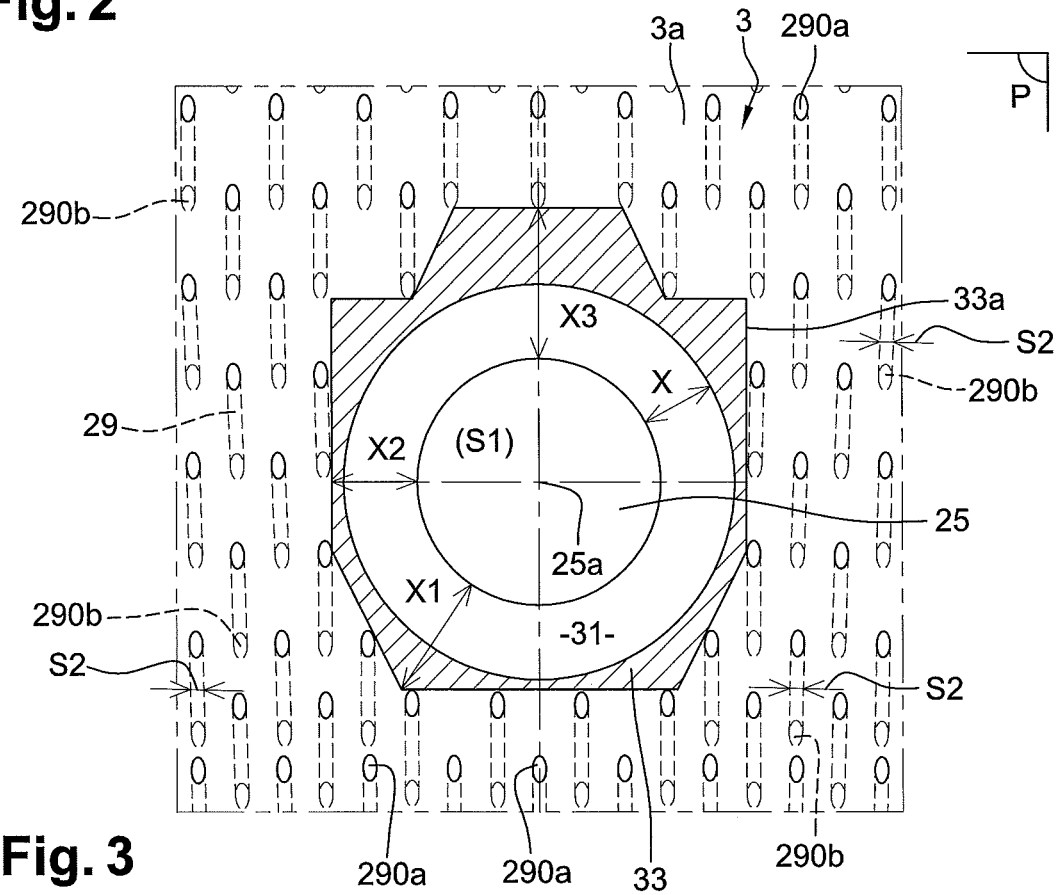
FIG. 3 shows a diagram of one said next step.

FIG. 3 shows that in addition to the holes 25 and/or 27, the inner 3 and/or outer 5 wall are crossed by multi-perforation holes 29.

Figure 2:
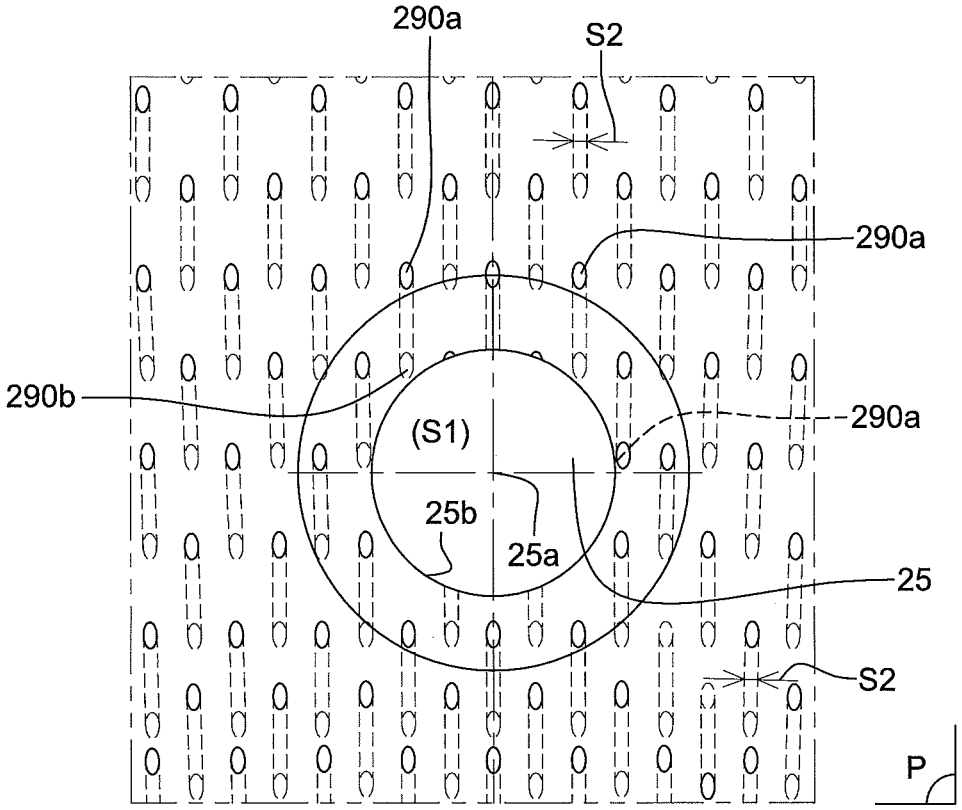
FIG. 2 each shows a diagram, with a view according to arrow IIa or IIb of FIG. 1, the same zone of said inner and outer walls (or shells) where a primary (or dilution) hole and multi-perforation holes are to be provided, the figure illustrating one of the steps of the configure and positioning of said hole, with a certain number of multi-perforation holes around it, in proximity.

In relation to FIGS. 2-10, we will first consider that, among multi-perforation holes 29, a primary hole 25 (but it could therefore be a dilution hole 27) is to be defined, with: as ENTRY DATA:

- a predefined multi-perforation template, also for the section (S1) and position of the hole 25, assumed in the example to be a primary hole,
- all around the hole 25, a safety zone 31 "with no hole", i.e. without any hole passing through the wall considered 3 or 5, of predefined width, i.e. with a predefined distance X in FIGS. 2,3, and as an OBJECTIVE, that of limiting the uncooled zones around the holes 25 (27) and keeping a maximum of multi-perforation holes 29 through the inner 3 or outer 5 wall considered; the wall 3 in the example.

In these figures, this surface or wall 3 can be assumed to be flat. It will therefore be understood that the width evoked is therefore a distance in the plane P) of the wall 3, in the example.

As shown in FIG. 2, we can start from an initial state in which (step b), on a template or in a software program, all the multi-perforation holes 29 of a zone or of a whole wall 3/5 have been virtually positioned. On this subject, it will be understood that the term "virtual" indicates that one intervenes here precisely on a template or in a software, and not on a real part. We therefore intervene upstream, before manufacturing (machining) the part.

The multi-perforation holes 29 have been distributed, including in the first safety zone 31 (width X), with, for each of these multi-perforation holes, virtual air inlets 290*a* and virtual air outlets 290*b*. On this subject, it must be understood that, for the implementation of the present method, both virtual air inlets 290*a* and virtual air outlets 290*b* are to be considered, independently of the (radially to the X axis) outer 3*a* or inner face 3*b* of the wall (here 3) considered. Indeed, as soon as the hole, here 25, crosses the whole wall 3, a weakening due to a too great proximity with surrounding multi-perforation (said adjacent) holes 29 can occur as much on the outer side 3*a* as on the inner side 3*b*. Thus, if the dotted lines of the multi-perforations 29 and their air outlets 290*b* indicate that, on the manufactured part, only the inlets 290*a* will be visible on the outer face 3*a* (idem on the face 3*b* with the outlets 290*b*), all the multi-perforations 29 and their inlets 290*a* and outlets 290*b* are to be taken into account.

In plane P) of the wall 3 considered here, the multi-perforations 29 have a predefined cross-section (S2) which can be common (or not) to all multi-perforations 29. In the example, it is common. And, still in the example, it is supposed to be circular.

In addition, the (each) primary hole 25 and/or dilution hole 27 shall be considered to be oriented perpendicular to the wall through which it is to pass; axis 25*a* in FIGS. 2,3 in particular.

On the other hand, the multi-perforations 29 may extend obliquely with respect to the plane P) of the wall 3 considered here, and therefore with respect to the orientation of the (each) primary hole 25 and/or dilution hole 27, materialized here by said axis 25*a*.

Having said this, it is therefore imperative to define as best as possible the uncooled zones around a hole 25 and to keep as many multi-perforation holes 29 around it as possible.

To this end, and before or after the above-mentioned definition, orientation and distribution of the multi-perforation holes 29 (step b), we will therefore:

position virtually on the wall 3, the (each) hole 25 (FIG. 2), and, in a step called a), define, over at least the predetermined distance (X) from and around this hole 25, a first predetermined safety zone 31 in which no air passage holes is to be made a priori (during the manufacture of the part 3 here); hence no multi-perforations 29 in this zone 31 (FIG. 3).

In a step called c), we will then virtually remove the multi-perforation holes 29 with a virtual inlet 290*a* or outlet 290*b* located in said first safety zone 31, as shown in FIG. 3.

In the example, twenty-three mufti-perforation holes or drills 29 within, or intersecting, the safety zone 31 were thus eliminated.

Figure 4:
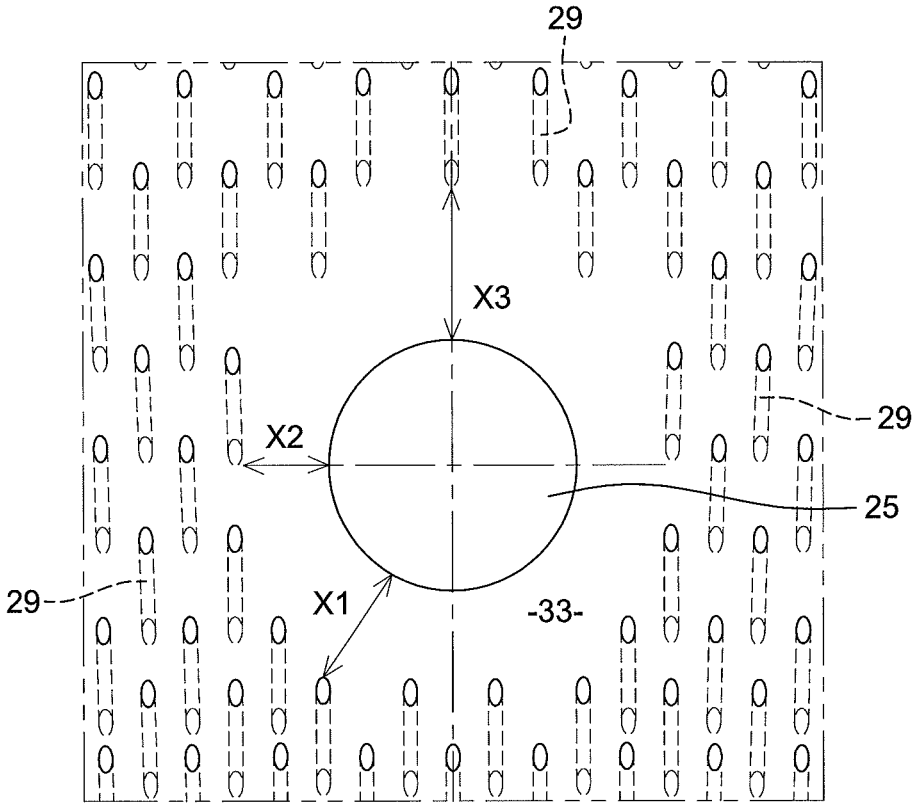
FIG. 4 shows a diagram of one said next step.

It is more than likely that then, as shown in FIG. 3, we will be able to note, in a step called d), that around the hole 25 exists, in plan P), a zone 33 with no hole:

- d1) more extensive than said first safety zone 31 (or extending at least locally around it),
- d2) and/or in which the distances in the plane P) between a perimeter 33*a* (outside) of said hole-free zone 33 and the hole 25 then vary according to the angular sector considered around this hole 25; distances X1, X2, X3, for example FIG. 3 or 4.

Figure 5:
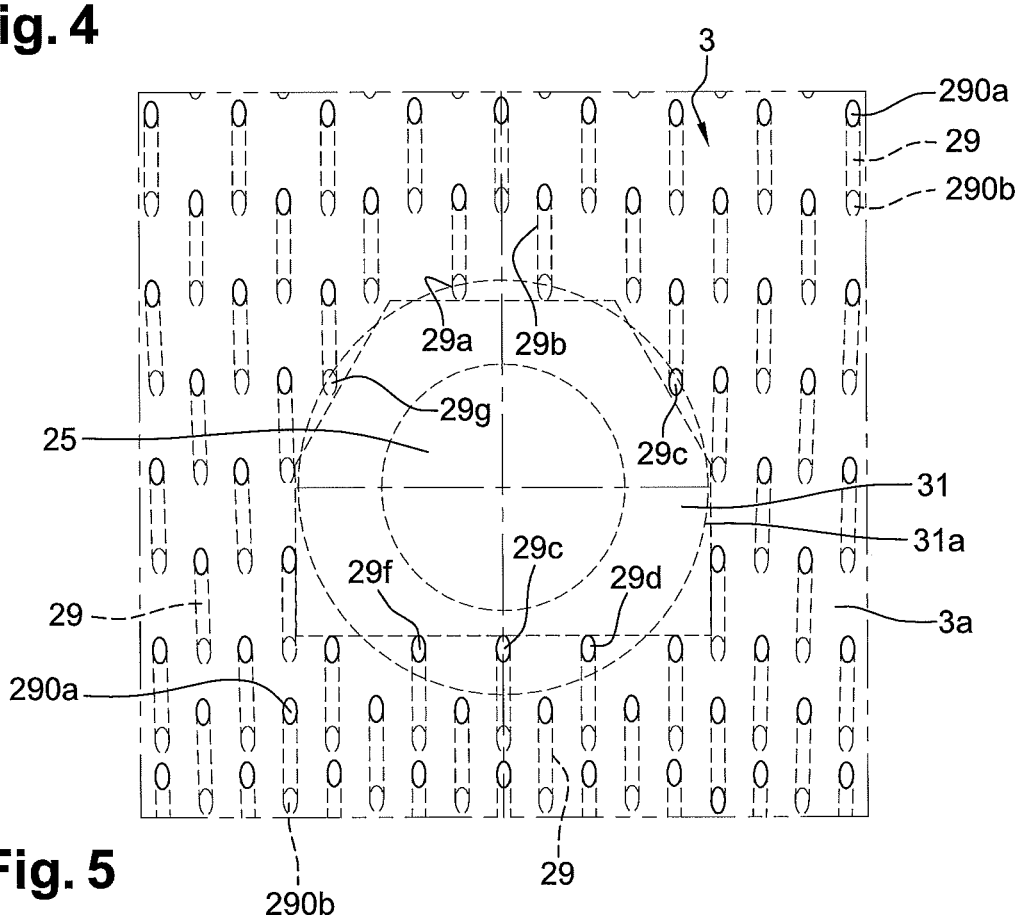
FIG. 5 shows a diagram of one said next step.
Figure 6:
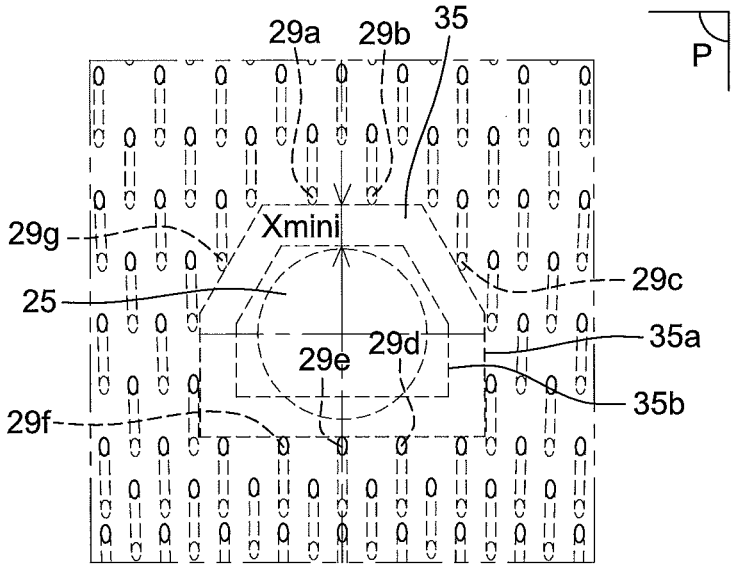
FIG. 6 shows a diagram of one said next step.

In this case, since the hole-free zone 33, which will therefore be non-(badly) cooled (in particular by the air having to pass through the remaining multi-perforations), is too large, we will virtually reintegrate at least some of the removed multi-perforations whose virtual inlet or outlet is located closest to the periphery 31*a* (outside) of said first safety zone 31; see markers 29*a*-29*g* FIGS. 5-6, i.e. seven reintegrated multi-perforations, in the example; step d21).

From then on, a second perimeter 35*a* passing through all the virtual inlets and outlets of all the multi-perforation holes (including of course the aforementioned 29*a*-29*g*) adjacent to said hole 25, and all around it, we will then be able to define towards this hole 25 a modified safety zone 35 (of width Xmini), of a different shape from the first safety zone, and of course without air passage hole (thus without any opening therefore); see FIG. 6; step d22).

Figure 7:
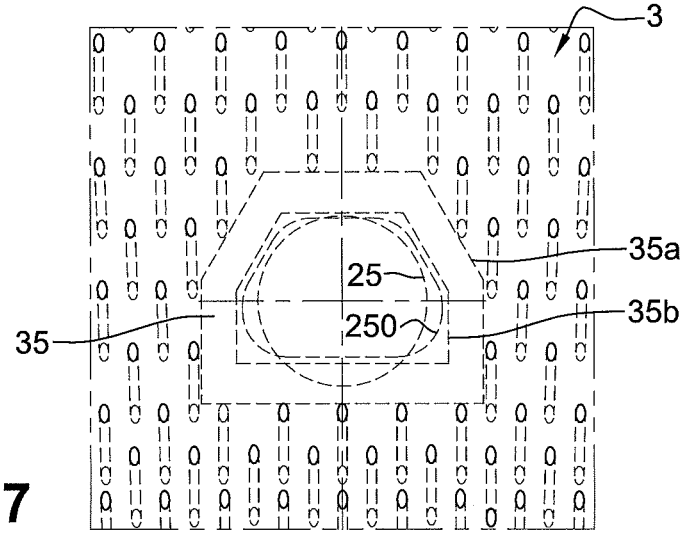
FIG. 7 shows a diagram of one said next step.

The two closed boundaries of this modified safety zone 35 are shown in FIG. 6 and FIG. 7: the second (outer) perimeter 35*a* and the inner contour 35*b*. The two closed boundaries 35*a*,35*b* are polygons, here with acute angles; but rounding of angles, or even curves other than straight lines are possible. For efficiency in the approach and if one wishes to keep a constant Xmini width along the second perimeter 35*a*, the two closed boundaries 35*a*,35*b* should preferably be parallel to each other. The shape defined by the contour 35*a* will therefore preferably define the shape of the inner contour 35*b*.

FIG. 7 also shows the contour of the "initial" virtual hole (marker 25)—which will not be maintained in its original configuration—and, by anticipation, the contour of the hole in its "final" configuration (marker 250).

It can thus be seen that the cylindrical hole 25 is no longer adapted to the multi-perforation environment. The hole 25 therefore loses its cylindrical shape to approach a profile 250 (approximately) parallel to the security contour: second perimeter 35*a*.

In fact, during this step d22) of redefining the modified safety zone, marked 35, one will have a priori chosen to keep (at least some of) the holes 29*a*-29*g* of multi-perforations virtually reintegrated.

At this stage of presentation, let us assume that we have chosen to keep all the multi-perforation holes 29*a*-29*g*.

Figure 8:
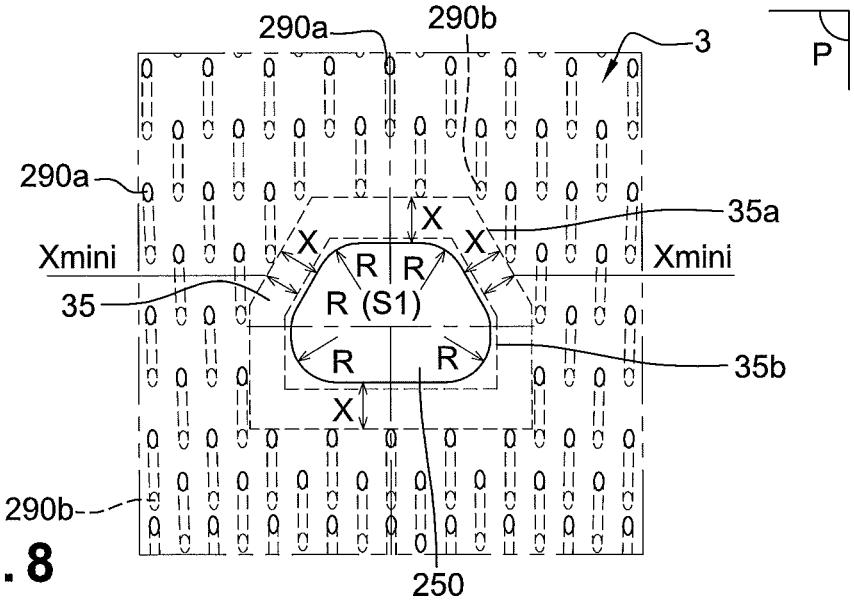
FIG. 8 shows, following the same view, a diagram of a variant with a different primary (or dilution) hole and a number of multi-perforation holes also different from those in [FIG. 3] to [FIG. 8].

In any case, and also on the basis of the principle:

to respect, around said hole to be redefined, said modified safety zone 35 (constant Xmini width), and to have the freedom to reposition said hole to be redefined within the limit 35*b* of the modified safety zone, we will close the method by carrying out a step called e), the effect of which is shown in FIG. 8, i.e. the redefinition of the initial hole 25 which has disappeared in favor of the modified profile hole 250.

Typically, the primary hole(s) 25 or dilution hole(s) 27 initially considered will be cylindrical and circular in cross-section. Although other shapes are possible, they are more difficult to integrate and machine.

At least in this case, said predetermined distance X will preferably correspond to a constant radius centered on axis 25*a* of the hole initially provided, here 25.

Thus, the first safety zone 31 will be uniform around the hole, here 25, to be configured and positioned as well as possible.

Favorably, both this first safety zone 31 and the modified safety zone 35 will depend on said virtual positioning and distribution of the multi-perforation holes 29 and on an (initially) predetermined distance between any multi-perforation hole and the primary or dilution hole under consideration, here 25. It could be the above-mentioned distance X. The limits of distance X will be:

at one end, the one among the virtual inlet 290*a* and outlet 290*b* located closest to the primary or dilution hole under consideration, here 25, at the other end, the outer contour 25*b* of the same primary or dilution hole considered, here 25; see FIG. 2 for example.

Thus, since the multi-perforation holes 29 have not changed between steps a) and e) above (FIGS. 2 and 8), we find the same distance X in FIGS. 2 and 8.

FIG. 8, is also marked the distance Xmini which is therefore the width of the modified safety zone 35, with X=Xmini+Δmini (Δmini being the delta necessary to reach the optimal passage section via the hole 250), this optimal passage section being the one which will offer, with said redefined shape, the most favorable air passage (highest flow, least turbulent flow) towards the furnace 18.

Since the primary or dilution hole 25 (initially) positioned virtually on the wall can then have a predetermined cross-section, it may be useful to hope that, when redefining the shape of this same primary or dilution hole, said predetermined cross-section is selected.

With regard to step e) of redefining the shape of said at least one primary or dilution hole, it may comprise a conservation of the predetermined section (S1) of this hole.

Thus, it will be possible to favor a preservation of the conditions initially defined with the original air passage section of the hole 25 and the initially distributed and positioned multi-perforation holes 29.

At this stage (e), once the modified safety zone 35, and thus the Xmini distance, has been chosen, it is possible that the initial section (S1) of the hole 25 will also be selected in the modified profile hole 250 and that this (these) modified profile hole(s) 250 will be suitable. In this case, the next step f1) will include stopping the process and making the final choice to retain this (these) modified profile hole(s) 250, with initial section (S1). This is the hypothesis used in FIG. 8.

If, however, said predetermined section (S1) is finally unsuitable, a subsequent step (f2) is then carried out comprising, without changing said modified safety zone 35, a new redefinition of the shape of said at least one primary or dilution hole which is thus repositioned, with a change in said predetermined section (S1), which is a priori smaller.

It may also be considered that the modified safety zone associated with the modified profile hole 250 cannot/will not be maintained. In this case, a step f3) comprising (at least) a reiteration of step d21) including a virtual reintegration of more or less multi-perforation holes than in the previous step d21) will be conducted, followed by a reiteration of steps d22) and e).

Figure 9:
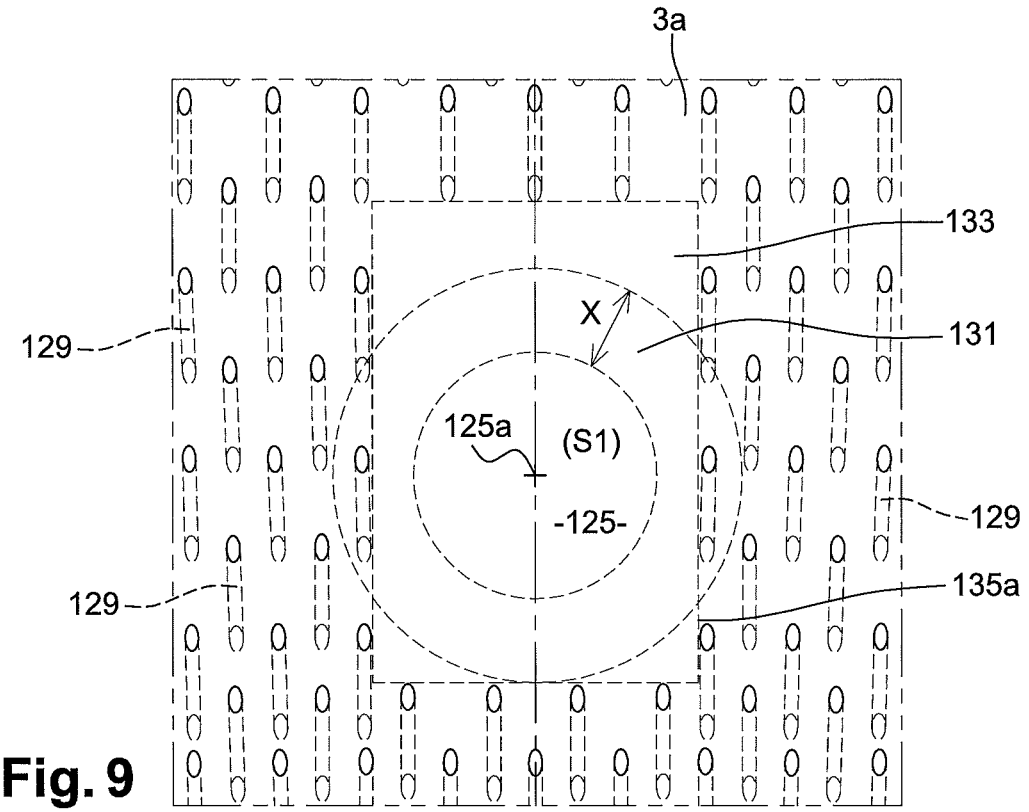
FIG. 9 shows a schematic diagram of one said next step
Figure 11:
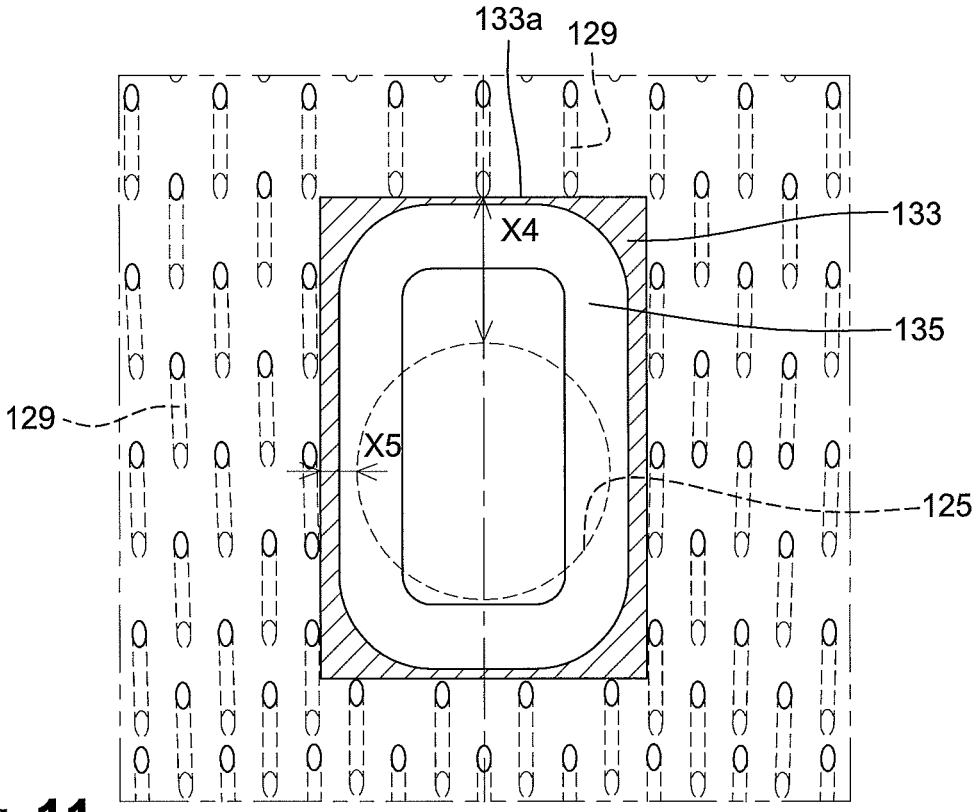
FIG. 11 shows a diagram of one said next step.
Figure 12:
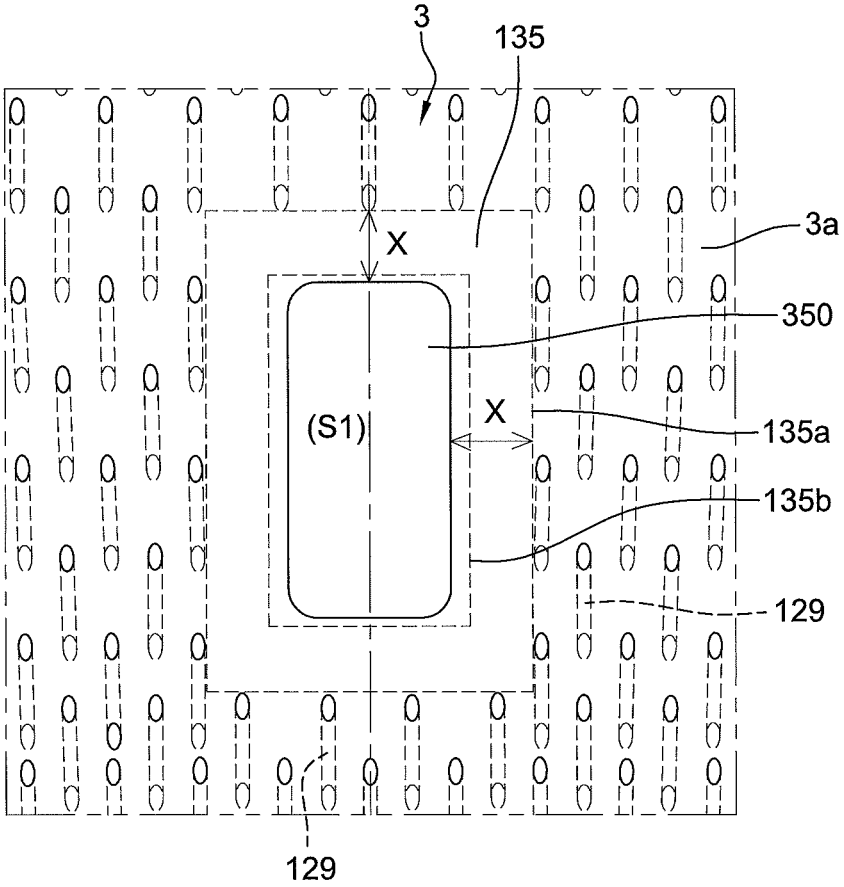
FIG. 12 shows a diagram of one said next step.

FIG. 9 and following show another example, with a different final shape of primary or dilution hole. Identical references are increased by 100. Thus, the final shape of the primary or dilution hole is 350; FIGS. 11-12.

The initial situation is always assumed to be as shown in FIG. 2. As before, we predefined:

in addition to a multi-perforation template, the section (S1) and position of the hole 125, always assumed in the example to be a primary hole, and all around the hole 125, a safety zone 131 without a hole passing through the wall considered 3 or 5, and of predefined width X; see FIG. 9.

Figure 10:
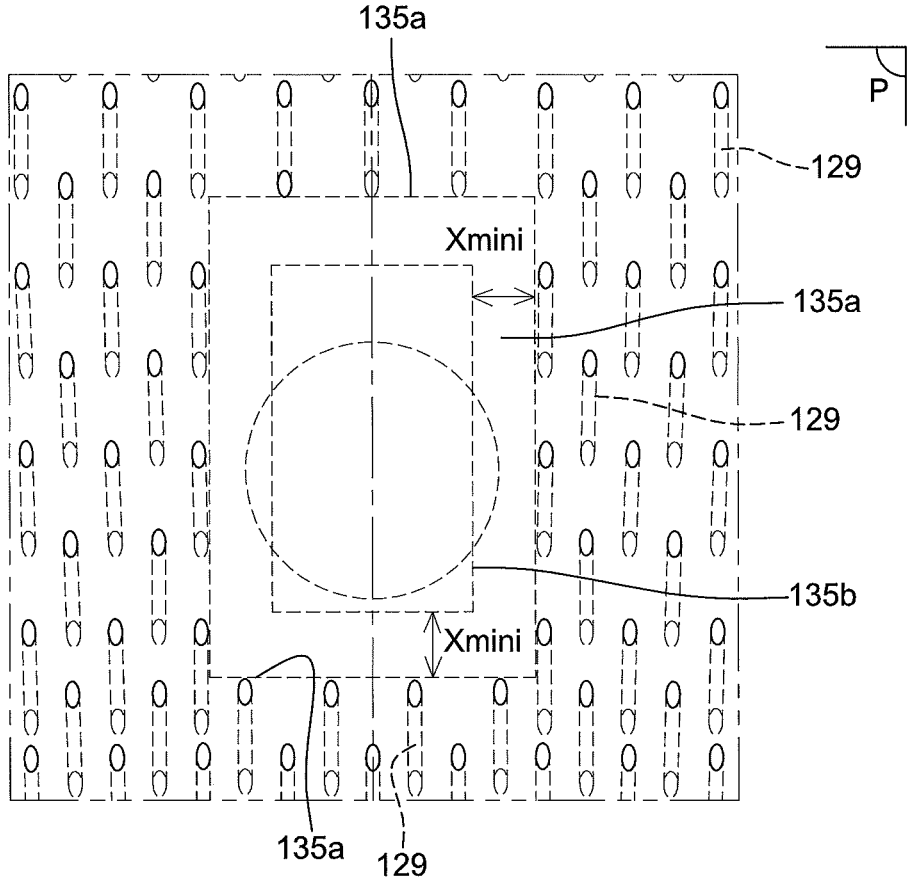
FIG. 10 shows a diagram of one said next step, FIG. 4] shows a diagram of one said next step.

In this FIG. 9, which is the counterpart of FIG. 5, one will also note, as in FIG. 10, the hole-free zone 133 and the modified safety zone 135, after having chosen in this case to reintegrate virtually twenty-one mutiperforation holes or drills 129 within (or intersecting) the initial safety zone 131 among all those initially eliminated (to see this, see comparison between FIGS. 2 and 9/10 as to the present muti-perforations 129).

From the second perimeter 135*a* (which thus passes through all the virtual inlets and outlets of all the multi-perforation holes adjacent to and surrounding said selected "primary or dilution" hole 125), we have here defined a so-called modified, rectangular, safety zone 135 without air passage holes, or openings. In both directions of the same plane P) as before, we find the safety distance Xmini.

Furthermore, it is within the closed inner contour 135*b* of the modified safety zone 135 that the final shape 350 of the selected primary or dilution hole was inscribed; see FIGS. 11,12, FIG. 11 being a mixture of FIGS. 3 and 8. The two boundaries 135*a*,135*b* are polygons.

We can see in FIG. 11 that the distances X4,X5 between the perimeter 133*a* of said zone 133 without hole and the "initial" primary hole 125 vary according to the angular sector considered around this hole. This zone 133 is still uncooled and extends around the modified safety zone 135. The hot spot surface (hatched area 33 FIG. 3 and 133 in FIG. 11, which is hotter because it does not have a cooling hole) is less optimized than the previous case; but the distribution of hot spots is homogeneous around the hole with the final shape 350, this for such a hole with a supposedly preserved section S1.

The rectangular shape of the modified safety zone 135 resulted in a final rectangular shape 350. For an efficiency in the approach and as we have, in the example, wished to keep a constant Xmini width all along the second perimeter 135*a* (in both directions of the same plane P), the two closed limits 135*a*,135*b* are parallel to each other. Furthermore, the conservation also chosen in the example of a hole of section S1 induced a real distance X which, as previously, is therefore such that X=Xmini+Δmini being the distance, in the plane P, necessary to reach a rectangular hole 350 of section S1 and with rounded corners taking into account certain imperatives, such as the manufacturing conditions.

Once the (each) hole 250 or 350 has been defined (shape, positioning, size . . . ), with its surrounding mufti-perforation holes 29 or 129 also defined, the relevant zones of walls 3 and/or 5 can be machined.

The invention claimed is:

1. A method for configuring and positioning air passage holes through a wall of an aircraft gas turbomachine combustion chamber, wherein at least one of a primary hole and a dilution hole for passing said air is defined which is positioned virtually on the wall, wherein, before machining said at least one of said primary hole and said dilution hole:

a) over at least one predetermined distance from and around said at least one of said primary hole and said dilution hole, a predetermined first safety zone is defined with no air passage hole therethrough, b) on the wall, including in the first safety zone, multi-perforation holes are positioned virtually and distributed, each of said multi-perforation hole having virtual air inlets and virtual air outlets, c) those of the multi-perforation holes which have said virtual air inlet or said virtual air outlet located in said first safety zone, are virtually removed, d) in a condition that a hole-free zone is then identified around said at least one of the primary hole and said dilution hole:

d1) which is more extensive than said first safety zone, and/or d2 where distances between a perimeter of said hole-free zone and said at least one of said primary hole and said dilution hole then vary according to an angular sector considered around said at least one of said primary hole and said dilution hole, then:

d21) at least some of the removed multi-perforation holes are virtually reintegrated with at least one of said virtual air inlet and said virtual air outlet closest to a periphery of said first safety zone, and d22) while keeping the multi-perforation holes virtually reintegrated, and from then on a second perimeter passing through all the virtual air inlets and said virtual air outlets of all the multi-perforation holes adjacent to and surrounding said at least one of said primary hole and said dilution hole, a modified safety zone which is free of air passage hole and which is of different shape from the first safety zone is defined towards said at least of said primary hole and said dilution hole, and, e) while respecting around said at least one of said primary hole and said dilution hole limits of said modified safety zone, a shape of said at least one of said primary hole and said dilution hole is redefined, with a freedom to reposition said at least one of said primary hole and said hole within said limits.

2. The method according to claim 1, wherein said at least one of said primary hole and said dilution hole is defined with initially a predetermined air passage section.

3. The method according to claim 2, wherein said predetermined air passage is cylindrical with a circular cross-section.

4. The method according to claim 1, wherein said at least one of said primary hole and said dilution hole positioned virtually on the wall has an axis and, in step a), said at least one predetermined distance corresponds to a constant radius centered on said axis.

5. The method according to claim 1, wherein said first safety zone and said modified safety zone depend on said virtual positioning and said distribution of said multi-perforation holes.

6. The method according to claim 1, wherein:

the second perimeter is defined by a polygonal line, and a contour of said redefined shape of said at least one of said primary hole and said dilution hole essentially follows said polygonal line.

7. The method according to claim 1, wherein said at least one of said primary hole and said dilution hole positioned virtually on the wall having a predetermined section, said predetermined section is selected, when redefining the shape of said at least one of said primary hole and said dilution hole.

8. The method according to claim 1, wherein:

said at least one of said primary hole and said dilution hole has a predetermined cross-section, and, in a condition that said at least one of said primary hole and said dilution hole with the redefined shape is unsuitable, and a subsequent step is then carried out comprising, in compliance with said modified safety zone, a further redefinition of the shape of said at least one least one of said primary hole and said dilution hole, with a change in said predetermined cross-section.

9. The method according to claim 1, wherein in a condition that:

that said at least one of said primary hole and said dilution hole with the redefined shape is not suitable, and the modified safety zone is no longer complied with, then a further step is carried out comprising:

at least one repetition of step d21) comprising a virtual reintegration of more or less multi-perforation holes than in the previous step d21), then a repetition of the steps d22) and e).

* * * * *